US010212980B2

(12) United States Patent
Lee

(10) Patent No.: US 10,212,980 B2
(45) Date of Patent: Feb. 26, 2019

(54) MECHANICAL-WAVES DISPERSING PROTECTIVE HEADGEAR APPARATUS

(71) Applicant: Choon Kee Lee, Denver, CO (US)

(72) Inventor: Choon Kee Lee, Denver, CO (US)

( * ) Notice: Subject to any disclaimer, the term of this patent is extended or adjusted under 35 U.S.C. 154(b) by 533 days.

(21) Appl. No.: 15/083,407

(22) Filed: Mar. 29, 2016

(65) Prior Publication Data

US 2017/0280813 A1 Oct. 5, 2017

(51) Int. Cl.
*A42B 3/12* (2006.01)
*A42B 3/28* (2006.01)
*A42B 3/06* (2006.01)

(52) U.S. Cl.
CPC ..... *A42B 3/121* (2013.01); *A42B 3/063* (2013.01); *A42B 3/283* (2013.01)

(58) Field of Classification Search
CPC ..... A42B 3/121; A42B 3/063; A42B 3/283
See application file for complete search history.

(56) References Cited

U.S. PATENT DOCUMENTS 1,833,708 A 1/1931 Ford
2,150,290 A 10/1937 Mulvey
2,618,780 A 7/1950 Cushman
3,462,763 A 8/1969 Schneider
3,761,959 A * 10/1973 Dunning ..... A42B 3/122 137/223
3,787,893 A * 1/1974 Larcher ..... A42B 3/062 2/413
4,324,005 A 4/1982 Willis
4,432,099 A * 2/1984 Grick ..... A42B 3/124 2/412
4,586,200 A 5/1986 Poon
5,014,365 A 5/1991 Schulz
5,129,107 A * 7/1992 Lorenzo ..... A42B 1/203 2/413
5,181,279 A 1/1993 Ross
5,204,998 A * 4/1993 Liu ..... A42B 3/121 2/411
5,263,203 A 11/1993 Kraemer
5,720,051 A * 2/1998 Johnson ..... A42B 3/122 2/413
5,815,846 A 10/1998 Calonge
5,890,232 A 4/1999 Park
5,913,412 A * 6/1999 Huber ..... A42B 3/28 2/413
6,219,850 B1 4/2001 Halstead
6,434,755 B1 8/2002 Halstead
6,681,408 B2 * 1/2004 Ku ..... A42B 3/122 2/411

(Continued)

*Primary Examiner* — Richale Quinn

(57) ABSTRACT

The present invention provides an apparatus to disperse and attenuate mechanical waves which travel through a human brain upon direct and indirect blunt head trauma. The apparatus comprises a pressurizable and ventable outer balloon shell encasing an inner hard shell. The pressurizable and ventable outer balloon shell releases a pressurized gas to atmosphere upon an impact to said pressurizable and ventable outer balloon shell. The pressurizable and ventable outer balloon shell is configured to compartmentalize an impact region, to reduce amplitudes of incident, reflected and transmitted mechanical waves and to dampen resonance of the mechanical waves delivered to both the apparatus and a human head.

12 Claims, 11 Drawing Sheets

(56) References Cited

U.S. PATENT DOCUMENTS

| | | | | |
|---|---|---|---|---|
| 7,089,602 | B2 | 8/2006 | Talluri | |
| 7,254,843 | B2 | 8/2007 | Talluri | |
| 8,196,226 | B1 | 6/2012 | Schuh | |
| 8,528,119 | B2 | 9/2013 | Ferrara | |
| 8,713,716 | B2 | 5/2014 | Krueger | |
| 8,732,868 | B2 * | 5/2014 | Ellis | A43B 7/1425 2/411 |
| 8,756,719 | B2 | 6/2014 | Veazie | |
| 8,814,150 | B2 | 8/2014 | Ferrara | |
| 8,844,066 | B1 | 9/2014 | Whitcomb | |
| 8,950,735 | B2 * | 2/2015 | Reynolds | F16F 7/127 2/413 |
| 8,966,669 | B2 | 3/2015 | Hines | |
| 9,113,672 | B2 | 8/2015 | Witcher | |
| 2012/0266366 | A1 | 10/2012 | Ferrara | |
| 2013/0283506 | A1 | 10/2013 | Archbold | |
| 2014/0068841 | A1 * | 3/2014 | Brown | A42B 3/122 2/413 |
| 2014/0123371 | A1 * | 5/2014 | Witcher | A42B 3/121 2/413 |
| 2015/0008085 | A1 * | 1/2015 | Ferrara | A41D 13/0155 188/377 |
| 2018/0092421 | A1 * | 4/2018 | Lee | A42B 3/063 |

* cited by examiner

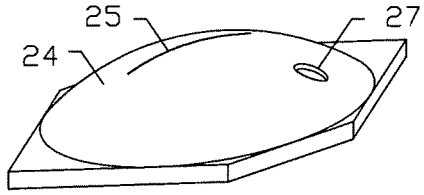
Fig. 5A
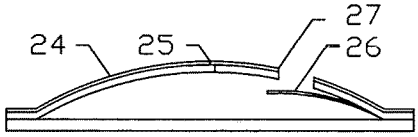
Fig. 5B
Fig. 5D
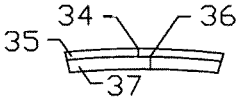
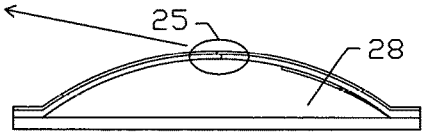
Fig. 5C
Fig. 5F
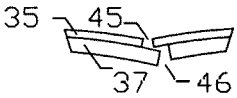
Fig. 5E
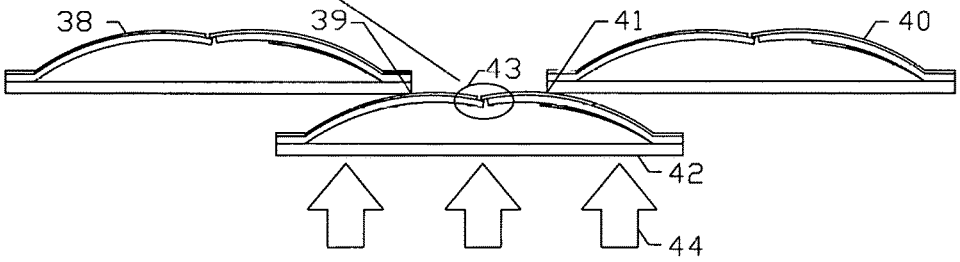

MECHANICAL-WAVES DISPERSING PROTECTIVE HEADGEAR APPARATUS

TECHNICAL FIELD

The present invention relates generally to the field of protecting the human brain upon a trauma. More specifically, the present invention provides an apparatus and methods to reduce an intensity of the mechanical waves from the trauma to the human brain.

BACKGROUND OF THE INVENTION

Closed head trauma has been understood mostly by physicians looking over surgical findings, radiologic imaging studies and autopsy series of deceased human beings. It has been described as 'coup-contrecoup' injury or 'acceleration-deceleration injury', based on location of damaged brain tissues and an obvious sequence of events of a sudden forward movement of the brain toward an impact followed by a bouncing-back recoil of the brain. There has been a good deal of consensus as to how an injury to a direct impact site of a brain tissue would occur, but theories are abound to explain mechanisms of the contrecoup injury to the brain tissue. As of 2016, these include 'positive pressure theory', 'rotational shear stress theory', 'angular acceleration theory', 'cerebrospinal fluid displacement theory' and 'negative pressure theory'. Yet none of these theories have been able to propose and verify unifying mechanisms of the brain injury of the so-called contrecoup injury and other associated injuries. In addition, there has not been a validation of a cause and an effect on a series of cases of chronic traumatic encephalopathy sustained by many combat soldiers and athletes. It stands to reason that we may have been blindsided by anatomic findings of the injury and the intricate nature and complex composition of the human head.

Injury to a human tissue can be understood by principles of mechanical waves in physics. A prime example of this which has been utilized for diagnostic purpose of human diseases over many decades is ultrasonographic evaluation of the human tissue. An ultrasound probe emits a range of ultrasonographic waves that are transmitted through the human tissue and a part of the ultrasonographic waves are reflected upon each tissue back to the ultrasound probe. The reflected ultrasonographic waves are registered by the ultrasound probe, which then are electronically interpreted to produce visualized images. Principles of ultrasonographic imaging technique essentially follow the principles of mechanical waves in physics, with the mechanical waves for the ultrasonographic imaging being ultrasound waves. What it means is that no matter how complex and intricate the human tissue would be, the human tissue is no exception for understanding consequences of a delivery of mechanical waves to said human tissue. An impact of a trauma to the human body should be understood as the delivery of mechanical waves to the human body which then undergoes intercellular and intracellular changes including macro- and micro-structural changes. Changes in electrochemical, molecular and signaling pathways of the tissue must occur, but as of now, we are at an early stage of our understanding of pathogenesis of the trauma and its consequences.

One of the extensively studied mechanical waves starting with a sudden big impact energy is seismologic waves which primarily consist of body waves traveling the earth's inner layer and surface waves rippling across the surface of the earth. The body waves comprises P (primary) waves which behave like sound waves and compress objects along their path, and S (secondary) waves which move through solid materials but not liquid materials. Of various physical properties of both the P and S waves, the boundary effects of the waves and the transfer function for the waves would potentially be important for the pathogenesis of the injury to the brain as the human head is a multi-layered structure consisting of several tissues with each having a distinctively different physical property. Layered from a surface to a deep portion of the brain, the head consists of skin and soft tissue underlying the skin, skull, dura mater, arachnoid membrane, leptomeninges and brain tissue proper in sequence. Inside the brain tissue proper, there are blood vessels and fluid sacs named as ventricular space lined by the leptomeninges.

All of these tissues would be damaged simultaneously in an instant without differences in a degree of the damage if the human head sustains a blunt trauma that has P and S waves having an amplitude and a frequency exceeding a tolerability limit of all of the tissues of the human head. However, there would be differences in the degree of the damage to each tissue of the human head if the amplitude and frequency of the P and S waves of the blunt trauma are within the tolerability limit of the tissues. Upon a blunt trauma to the human head which has an amplitude and a frequency of the P and S waves within the tolerability limit of the tissues, presence of a collected liquid in the head such as in blood vessels and ventricles and differences in proportion of liquid content of the tissues would play a role by the transfer function of medium in differences in the degree of the damage to the tissues of the human head. The amplitude of the P and S waves of the blunt trauma may be amplified or deamplified based on a transfer function of the blood vessels, ventricles and a liquid content of the brain tissue proper. In the field of ultrasonographic imaging of human tissue, it is a well-known phenomenon to obtain an augmented amplitude of reflected ultrasound waves back from a tissue behind a fluid sac, which is called acoustic enhancement. It is conceivable to anticipate such amplification of the P and S waves from a tissue behind large sized blood vessels and ventricles located in a relatively linear path from an original site of the blunt trauma on the human head. It is intriguing to note that two of the most common sites of the chronic traumatic encephalopathy are thalamus and amygdala just below the fluid filled lateral and third ventricles of brain, which suggests that an amplitude of the mechanical waves of an impact on a frontal or a vertex portion of a skull coming to the thalamus and the amygdala via the lateral and thrid ventricles may be amplified by presence of a cerebrospinal fluid inside the lateral and third ventricles by a mechanism of the transfer function of a medium similar to the acoustic enhancement of the ultrasonographic imaging.

The surface waves which is known to ripple across the surface of the earth would also be applicable to our understanding of the pathogenesis of the injury to the human head as the brain is relatively spherically round in configuration and encased by the skull which serves to contain the brain in a bowl configuration. Upon a blunt trauma to the human head which has an amplitude and a frequency of the Love waves and the Rayleigh waves of the surface waves within the tolerability limit of the tissues, both the brain and skull may develop resonant amplification of the surface waves, increasing a damage potential of the blunt trauma to the brain.

Both the boundary effects of and transfer function for the P and S waves of the blunt trauma would be useful for mitigating the injury to the brain tissues. If both the P and S waves of the blunt trauma run into a single boundary generated by a single dividing layer inside a protective shell for the human head at an angle, which is understood as a fixed end for the boundary effects in physics term, there is no displacement at the single boundary of the single dividing layer inside the protective shell but stress (amplitude) of the P and S waves on the single boundary of the single dividing layer of the protective shell is known to be temporarily doubled from the original stress of the P and S waves as long as the P and S waves are maintained within the shell. If the P and S waves are released from the shell upon an impact on the single boundary of the single dividing layer of the shell, an amplitude of the P and S waves on the single boundary of the single dividing layer is to be proportionally reduced. If the protective shell has two boundaries, incident P and S waves to the first boundary of the first dividing layer will be both reflected back and transmitted to the second boundary of the second dividing layer. Similarly, a part of the P and S waves will be reflected from the second boundary of the second dividing layer, heading back to an opposite side of the first boundary of the first dividing layer, and the other part will be transmitted to the brain tissue. The reflected P and S waves from the second boundary of the second dividing layer will collide at the first boundary of the first dividing layer with another P and S waves bouncing back from an original site of the blunt trauma toward the first boundary of the first dividing layer, thus neutralizing at the first boundary of the first dividing layer the amplitude of stress from the P and S waves from both the second boundary of the second dividing layer and the original site of the blunt trauma to an extent. If the P and S waves on to the second boundary of the second dividing layer are released from the shell upon the impact much the same way as the P and S waves on to the first boundary of the first dividing layer are released, an overall amplitude of the P and S waves to the second boundary of the second dividing layer will be accordingly reduced. If there are multiple boundaries and the P and S waves are released upon their impact on each boundary of a dividing layer before the P and S waves get to the brain tissue, the amplitude of the P and S waves to the brain tissue will be reduced proportionally to the number of the boundaries of the dividing layers.

A transfer function of a medium for P and S waves depends on fundamental frequency of the medium, which may amplify or deamplify the P and S waves coming from a source. Of solid materials, rigid elastic materials, liquid materials and gaseous materials, the gaseous materials such as air have the lowest fundamental frequency. If the P and S waves from the original site of the blunt trauma go through a gas medium before reaching the brain tissue, these waves will be deamplified resulting in a decrease in an amplitude of the waves to the brain tissue.

Resonant amplification of the surface waves rippling through the protective shell and the human head should also be deamplified as the surface waves in phase with the P and S waves would amplify the P and S waves, increasing the damage potential of the blunt trauma. One way of reducing the resonant amplification of the surface waves is to use the free-end boundary effect at a circular rim end of each boundary of a dividing layer inside the protective shell. At the circular rim end of the boundary of the dividing layer which is free-ended in physics term, traveled waves from the blunt trauma generate zero stress to the circular rim end but displacement of the circular rim end is temporarily doubled. If the free-ended circular rim end is made displaced freely without reflecting back or transmitting the surface waves to other boundaries, the free-ended circular rim end of the boundary of the dividing layer will oscillate on its own upon arrival of the traveled surface waves without further amplification.

Intensity of an amplitude of the mechanical waves delivered to the brain tissue depends on a mass (weight) of a source generating the mechanical waves multiplied by a velocity of an impact from the source and a mass (weight) of a victim and a stopping distance of the impact by the victim colliding with the source: $KE=\frac{1}{2}\times mv^2$ where KE is kinetic energy before an impact, m is mass in kg and v is velocity in meter/second. Since the stopping distance of the impact by the victim is a relatively fixed value (a head does not fall off from a body) and the velocity of the impact from the source could be a relatively fixed value depending on a type of collision, for an example in a collision during a close body fighting sequence, the weight of both the source and victim for the most part would determine the amplitude of the mechanical waves from the impact. What this suggests is that a one-size-fits-all protective headgear is not proper for a group of human beings with a range of different body weights. A person with a lighter body weight as a source of an impact of a blunt trauma on the other person will incite a less powerful amplitude of mechanical waves of the impact than a person with a heavier weight. By the same token, a person with a heavier weight as a victim of a blunt trauma to the head may not be protected well by a protective headgear which is known to protect a person with a lighter weight. Different types of an impact of the blunt trauma would change the velocity of the source of the impact and of the victim. For examples, a collision of a professional bicyclist at a high speed to a stationary object such as a utility pole on street should be different from two football players wrestling with each other and abutting each other's head.

There are two methods to reduce the amplitude of the mechanical waves delivered to the brain tissue, using the multi-layered protective shell with the aforementioned principles: one method is to increase the number of the boundaries inside the protective shell as practically many as possible to a point there would not be a serious tissue injury to the brain tissue; the other is to pressurize the protective shell with a gas and to let the gas released upon an impact from the blunt trauma. If an amplitude of mechanical waves of a blunt trauma does not exceed a resistive pressure of an impacted gas inside the protective shell, the amplitude of the mechanical waves will go through the layered boundaries in the way described above except that the impacted gas would not be released and some of the mechanical waves will transform to heat and some others transmitted to the brain tissue. If the amplitude of the mechanical waves of the blunt trauma exceeds the resistive pressure of the impacted gas inside the protective shell, then a portion of the impacted gas will be released from the protective shell upon the impact of the blunt trauma. It results in a depletion of a portion of an impact energy carried in the impacted gas, which is a decrease in the amplitude of the mechanical waves reaching the brain tissue. While the number of the layered boundaries of the protective shell is fixed once manufactured, the pressure of the gas in the protective shell can be variably adjustable based on a weight of a person wearing the protective shell and anticipated types and scenarios of an injury. Combining both methods for the protective shell would therefore be more advantageous to using either method alone.

SUMMARY OF THE INVENTION

To achieve the goals of reducing an amplitude of mechanical waves of a blunt trauma to a human head and resonance of the mechanical waves delivered to the human head, the present invention comprises a pressurizable and ventable outer balloon shell, conforming to the human head, which encloses a number of independent inner layers stacked up inside the pressurizable and ventable outer balloon shell. The pressurizable and ventable outer balloon shell is inflated and pressurized by a gas which is quantifiably releasable upon the blunt trauma through gas valves to atmosphere once a threshold for venting is exceeded by the mechanical waves of the blunt trauma. Pressure of the gas inside the pressurizable and ventable outer balloon shell is made variably adjustable and monitored by a pressure sensor device which has an alarm function of both a sound alarm and flashing lights. The independent inner layer comprises a sheet to which a number of individual ventable gas cells are attached, arranged in a mosaic pattern. Around a rim of the pressurizable and ventable outer balloon shell, there is provided an enlarged space in which each inner layer ends up with a ruffled free-ended margin. Under the pressurizable and ventable outer balloon shell, there is provided an inner hard shell which covers the human head. A soft padding is provided in between the human head and the inner hard shell. The inner hard shell is at least three layered with an outer layer and an inner layer made of same materials as for the outer layer and a mid layer made of materials having a lower fundamental frequency than that of the materials for the outer and inner layers.

In one embodiment, the pressurizable and ventable outer balloon shell comprises a dome configured in a substantially hemispherical bowl shape and a ballooned rim adjoining a lower circumferential margin of the dome. The pressurizable outer balloon shell is an airtight inflatable shell, and has a pressurized-gas intake valve located on a lower surface of a posterior ballooned rim and a group of pressure-triggerable gas release valves located on the lower surface of the ballooned rim along the circumference of the ballooned rim. On a side of an outer surface of the ballooned rim, the pressure sensor device having the alarm function of the sound alarm and flashing lights is installed, which measures an internal pressure of the pressurizable outer balloon shell. The dome and the adjoining ballooned rim are configured to slidably encase the inner hard shell. Both the pressurizable outer balloon shell and the inner hard shell are configured to cover an area of the human head comprising a part of frontal, an entire parietal, a majority of temporal and an entire occipital region. The pressurizable outer balloon shell is made of a thermoplastic elastomer such as polyurethane elastomer, high-density polyethylene based elastomer or polyamide based elastomer which withstands a range of internal pressure of the pressurizable outer balloon shell above atmospheric pressure over a range of temperature from 0° F. to 175° F. and a blunt impact without material failure.

In one embodiment, the pressurized-gas intake valve is in a configuration of Schrader-type valve for pressurized gas embedded inside the lower surface of the posterior ballooned rim with an opening of the pressurized-gas intake valve disposed on the lower surface, without protruding parts beyond the lower surface. In one embodiment, the pressure-triggerable gas release valves are configured in a spring-operated pressure release valve which is a quick release valve. The spring is configured as compression spring which provides resistance to a range of axial compressive pressure up to a predetermined set pressure limit beyond which the spring yields to the axial compressive pressure. The pressure-triggerable gas release valves are embedded inside the lower surface of the circumference of the ballooned rim in a way at least one gas vent is assigned to each anatomic region of the head, which is to facilitate release of the impacted gas from the impacted region of the head to the nearest pressure-triggerable gas release valve without dissemination of the impacted gas around an internal space of the protective outer shell. It is to reduce rippling surface waves traveling across the protective outer shell, thereby reducing resonant amplification of the amplitude of the mechanical waves.

In one embodiment, the dome and the ballooned rim at the lower circumferential margin of the dome are made as a single piece without connecting parts or seams, not as two separate pieces affixed together, which is to avoid material failure upon repetitive impacts of the blunt trauma. Both the dome and ballooned rim provide an airtight, inflatable and pressurizable space which encloses a number of independent inner layers in a dome configuration concentrically stacked up. Both an outer wall and an inner wall of the dome, made of the semirigid elastomers, are configured to be reversibly and depressibly deformable at an angle to a planar surface of the wall upon an impact of the blunt trauma. The outer and inner wall of the dome and the ballooned rim are not physically attached to the independent inner layers, but form a closed enclosure to enclose the independent inner layers in the dome configuration conforming to the dome of the dome and the ballooned rim in a way the independent inner layers do not move freely inside the enclosure. The ballooned rim provides a space in which a free-ended circumferential margin of the independent inner layers is enclosed.

In one embodiment, the independent inner layer is configured as three-ply sheet having an inner ply made of a thermoplastic elastomer, a mid ply of a woven cloth fabric and an outer ply of the thermoplastic elastomer. The three plies are compressed together under heat to meld the thermoplastic elastomer plies with the cloth ply to impart enough hardness to maintain the dome configuration with reversible deformability over a range of temperature and enough tear strength to withstand repetitive deformative impacts from the blunt trauma without material failure, while dampening a fundamental vibration frequency of the thermoplastic elastomer by a lower fundamental vibration frequency of the woven cloth fabric. A plurality of individual ventable gas cells are fixedly attached to an inner surface of the independent inner layer, with each ventable gas cell separated from the other ventable gas cell by a distance and arranged in the mosaic pattern. In a space between each ventable gas cell, the independent inner layer is perforated with small holes that go through an entire three-ply sheet of the independent inner layer. The circumferential margin of the independent inner layer is free-ended without attachment to an inner wall of the ballooned rim and is made corrugated and slit a number of times at a right angle to the margin for a distance to produce a plurality of strips in ruffled configuration. The ruffled free-ended circumferential margin of the independent inner layer is packed in the ballooned rim, which provides stationary anchoring of the independent inner layer inside the protective outer shell without physical attachment to the inner wall of the ballooned rim.

In one embodiment, the ventable gas cell is configured in a relatively broad base fixedly glued to a semi-elliptical top of a relatively short vertical height fixedly attached to the broad base to form a relatively flat semi-elliptical dome. The broad base is fixedly attached to the inner surface of the independent inner layer and the semi-elliptical dome protrudes in a direction away from the inner surface of the independent inner layer. The ventable gas cell is made of a plurality of thermoplastic elastomers which impart bulging distensibility and compressible deformability to the semi-elliptical dome. The semi-elliptical dome is a two-ply sheet, having an outer ply bonded with an inner ply under heat to form an inseparable sheet. The outer ply is made of one thermoplastic elastomer and has a higher hardness on the Shore scale than the inner ply made of a different thermoplastic elastomer. In a relatively mid-line of the semi-elliptical dome, there is provided a gas vent slit of a length along a longitudinal axis of the semi-elliptical dome through which gas is to be vented out. The slit is a two-ply structure, having an outer slit made on the outer ply and an inner slit made on the inner ply. The outer slit is offset with the inner slit on the longitudinal axis of the semi-elliptical dome, with the outer slit separated by a distance from the inner slit in a way that the outer ply covers the inner slit for the offset distance between the outer slit and the inner slit. The offset configuration of the two slits is to let the semi-elliptical dome distended by a pressurized gas which cannot escape through the inner slit from the semi-elliptical dome unless both the outer and inner slits are open. The semi-elliptical dome is compressible into two halves with each half on one side of the outer slit by compression on each half of the semi-elliptical dome on each side of the outer slit. If the compression of the semi-elliptical dome is deep enough toward the broad base, both the outer slit and inner slit are open and let the pressurized gas vented out from the ventable gas cell. On one side of the semi-elliptical dome, there is provided a gas intake opening with an one-way valve underneath the inner ply of the semi-elliptical dome through which a gas moves into the ventable gas cell upon pressure. When the gas is pumped into the pressurizable outer balloon shell through the Schrader-type valve located in the lower surface of the posterior ballooned rim, it distends the pressurizable outer balloon shell and at the same time distends the ventable gas cells through the gas intake opening of the semi-elliptical dome of the ventable gas cells of the independent inner layer. Upon an impact of the blunt trauma to the pressurizable and ventable outer balloon shell, not only does the pressurizable and ventable outer balloon shell release the pressurized gas, thereby reducing an amplitude of mechanical waves from the impact delivered to the pressurizable and ventable outer balloon shell, but also the pressurizable and ventable outer balloon shell compartmentalizes a region for releasing the pressurized gas from the region of the blunt trauma to preferentially reduce the amplitude of the impact of the blunt trauma at the site of the impact.

In one embodiment, the independent inner layers are concentrically stacked up inside the pressurizable and ventable outer balloon shell in a way a semi-elliptical dome of a ventable gas cell of the first independent inner layer touches an outer ply of the second independent inner layer disposed underneath the first independent inner layer. The semi-elliptical dome of the gas cell of the first independent inner layer is arranged with a group of the ventable gas cells of the second independent inner layer in an interlaced configuration along the vertical axis of the semi-elliptical dome. An edge of a border of the broad base of one ventable gas cell of the second independent inner layer is aligned with a convex portion of one side of the semi-elliptical dome of the ventable gas cell of the first independent inner layer along the vertical axis of the semi-elliptical dome. The other convex portion of the other side of the semi-elliptical dome of the ventable gas cell of the first independent inner layer is aligned with an edge of a border of the broad base of the other ventable gas cell of the second independent inner layer. This stacking-up configuration of ventable gas cells minimizes an area of contact between two sequentially stacked-up independent inner layers, which is to reduce transmission of the mechanical waves through the stacked-up independent inner layers. Additional independent inner layers are stacked up in the same configuration as for the first and second layers.

In one embodiment, a gas pressure in the pressurizable and ventable outer balloon shell is monitored by a piezoresistive pressure sensor device which is a sealed pressure sensor type and battery-operated. It is configured to measure a range of operational pressure of the gas inside the pressurizable and ventable outer balloon shell and to generate both the sound alarm and flashing lights. A pressure sensor circuit board with a battery of the pressure sensor device is affixed to the inner wall of the ballooned rim and an alarm part of the pressure sensor device protrudes through the wall of the ballooned rim to an outer surface of the ballooned rim for a piezoelectric speaker generating the sound alarm and a visual display for flashing lights. The visual display part comprises color-coded light emitting diodes which flash a certain type of color such as blue if the gas pressure inside the pressurizable and ventable outer balloon shell is above or red if below a certain threshold of the gas pressure that the pressurizable and ventable outer balloon shell is set to maintain for proper operational protection of a head of a user.

In one embodiment, a gas pressure in the pressurizable and ventable outer balloon shell is variably adjustable over a range of pressure according to a sum of a maximum anticipated body weight of a source and a known weight of a victim of a blunt trauma, and to an anticipated maximum gravitation force of the blunt trauma which depends on a velocity of the blunt trauma. A heavy weight of the source and a high velocity of the anticipated type of the trauma would require a higher gas pressure; a lower gas pressure would suffice for a light weight of the user and a slow velocity of the anticipated type of the trauma. For an example, an average body weight of football players according to the National Football League Prototypes Data for Draft Guides in 2011 is 240 lbs, ranging from 180 lbs of kick returners and place kickers to 300 lbs of offensive guards and offensive tacklers. Therefore, the range of the average body weight for the pressure adjustment for the gas pressure ranges from 360 lbs to 600 lbs, since the blunt trauma is a bidirectional event, as the gas pressure to withstand a collision should tolerate the sum of the weight of both the source and victim. Assuming that up to 10% standard deviation would be permissible for the average weight, the weight scale for titrating the gas pressure then should be between 320 lbs to 660 lbs. In the football example, the maximum gravitational force of an impact by a person is known to be 150 g. Since the amplitude of the mechanical waves of the blunt trauma temporarily is doubled at a fixed boundary of a skull, a gravitational force that needs to be withstood by the pressurizable and ventable outer balloon shell should be 300 g±30 g (10% S.D.). To add a safety margin over the maximum value of 330 g, a 400 g would be in theory suitable for adjusting the gas pressure. The known range of gravitational forces being responsible for a concussion of a brain is from 60 g to 170 g, indicating a need to reduce the gravitational force which a victim could sustain without the concussion to below 60 g±6 g (10% S.D.). Adding a safety margin to this, it would be reasonable for the pressurizable and ventable outer balloon shell to reduce a delivered gravitational force to the brain of the victim to less than a 30~40 g. If a velocity of the impact of the blunt trauma is 30 mph, a time from the very first contact between the source and the victim to a full impact would be about 20~30 milliseconds. In this scenario, the pressurizable and ventable outer balloon shell should release the pressurized gas within 20~30 milliseconds to lower the gravitational force to less than 30~40 g delivered to the brain to avoid the concussion. Calculations should be different for young children or light weighted people and for other types of trauma scenarios such as motor vehicle accidents or a cyclist hitting a stationary object at a high speed or hitting a pedestrian walking on a street.

In one embodiment, the inner hard shell is provided in a dome configuration, and comprises at least three layers with both the outer and inner layer made of an impact resistant polymer such as carbon-fiber-reinforced-polymer or glass-fiber reinforced nylon and the mid layer made of a plurality of non-polymeric porous materials such as woven cloth fabrics. All three layers are bonded tightly to protect the skull against fracture upon the impact of the blunt trauma to the head. The mid layer of the non-polymeric porous materials serves to reduce transmission of the amplitude of the blunt trauma through the inner hard shell on both ways, i.e., from a source of the blunt trauma to a victim and from the victim to the source.

BRIEF DESCRIPTION OF THE DRAWINGS

FIG. 2A represents an outline view of the pressurizable and ventable outer balloon shell without independent inner layers inside the pressurizable and ventable outer balloon shell; FIG. 2B shows a posterior-to-anterior outline view of the pressurizable and ventable outer balloon shell without the independent inner layers; FIG. 2C~2F show a schematic profile outline view of the independent inner layers and FIG. 2G shows the inner hard shell; FIG. 2H shows a schematic profile outline view of the pressurizable and ventable outer balloon shell with the independent inner layers encased inside the pressurizable and ventable outer balloon shell and of the inner hard shell.

FIG. 3A represents a schematic profile outline view of the ventable gas cells arranged in tandem along the inner surface of the independent inner layer; FIG. 3B~3D show a schematic outline view of a hexagonal ventable gas cell; FIG. 3E~3G show a schematic outline view of a pentagonal ventable gas cell.

FIG. 4A shows a schematic profile outline view of the independent inner layers in an interlaced configuration; FIG. 4B-4C show two different layouts of the ventable gas cells on each independent inner layer; FIG. 4D shows a see-through outline view of both independent inner layers stacked up together in the interlaced configuration.

FIG. 5A~5F show a schematic illustration of an offset configuration of a gas vent slit on a semi-elliptical dome of the ventable gas cell: FIG. 5A shows a three-dimensional view of the hexagonal ventable gas cell; FIG. 5B shows a profile outline view of the semi-elliptical dome; FIG. 5C shows the semi-elliptical dome in a closed configuration; FIG. 5D shows a magnified profile outline view of the offset slit in the closed configuration; FIG. 5E shows semi-elliptical domes in an open configuration upon an impact; FIG. 5F shows a magnified profile outline view of the offset slit in the open configuration upon the impact.

FIG. 6A shows a profile outline view of a three-ply structure of the independent inner layer; FIG. 6B shows a three-dimensional view of an inner ply of the independent inner layer; FIG. 6C shows a three-dimensional view of a mid ply and an outer ply of the independent inner layer; FIG. 6D shows a schematic profile outline view of a section of the pressurizable and ventable outer balloon shell comprising an outer and an inner wall of the pressurizable and ventable outer balloon shell enclosing a plurality of stacked-up independent inner layers.

FIG. 7A depicts the pressurizable and ventable outer balloon shell enclosing a plurality of stacked-up independent inner layers before the impact; FIG. 7B illustrates the pressurizable and ventable outer balloon shell and the ventable gas cells attached to the independent inner layers venting a gas upon the impact.

FIG. 8A-8B show a collision between two unprotected human heads; FIG. 8C-8D show a collision between two protected human heads with each head wearing a headgear having the pressurizable and ventable outer balloon shell; FIG. 8E illustrates mechanical waves resulting from the collision between the unprotected human heads; FIG. 8F shows mechanical waves resulting from a protective headgear having a single layered pressurizable and ventable outer balloon shell; FIG. 8G shows mechanical waves resulting from a protective headgear having a pressurizable and ventable outer balloon shell with three inner layers inside the pressurizable and ventable outer balloon shell.

FIG. 9A shows a schematic profile outline view of the pressurizable and ventable outer balloon shell having a pressurized-gas intake valve, pressure-triggerable gas release valves and a pressure sensor device; FIG. 9B shows a schematic three-dimensional view of a ballooned rim portion of the pressurizable and ventable outer balloon shell.

FIG. 10A shows a schematic view of the ruffled free end of the independent inner layer; FIG. 10B depicts a schematic profile outline view of sine-wave configurations of the ruffled free end; FIG. 10C-10D show the surface waves causing resonant amplification of mechanical waves upon the impact on an unprotected human head; FIG. 10E-10F show the surface waves with resonant amplification of mechanical waves upon the impact on a protected human head wearing the protective headgear having a pressurizable and ventable outer balloon shell.

FIG. 11A shows a schematic three-dimensional view of the inner hard shell; FIG. 11B shows a schematic profile outline view of a three-layered structure of the inner hard shell.

DETAILED DESCRIPTION OF THE DRAWINGS

As described below, the present invention provides a mechanical-waves dispersing protective headgear apparatus and methods of use. It is to be understood that the descriptions are solely for the purposes of illustrating the present invention, and should not be understood in any way as restrictive or limited. Embodiments of the present invention are preferably depicted with reference to FIGS. 1 to 11, however, such reference is not intended to limit the present invention in any manner. The drawings do not represent actual dimension of devices, but illustrate the principles of the present invention.

Figure 1B:
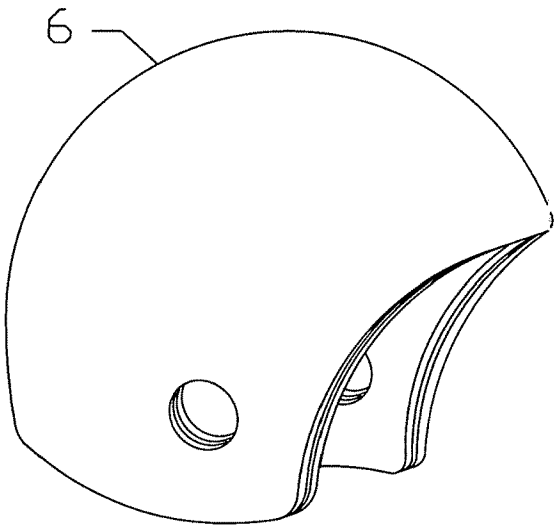
FIG. 1A-1B show a schematic presentation of a pressurizable and ventable outer balloon shell and an inner hard shell, respectively.
Figure 1A:
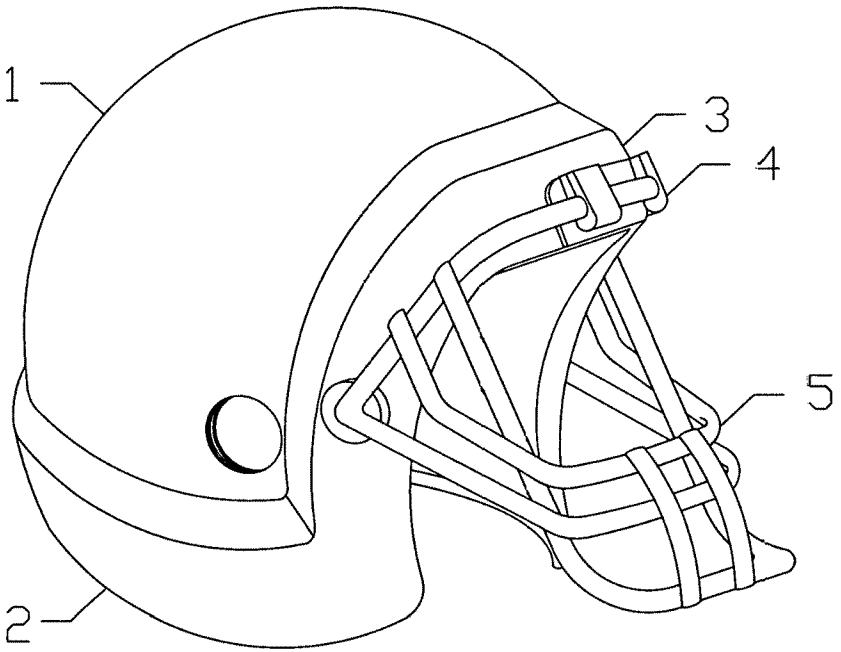

FIG. 1A-1B show a schematic example of a pressurizable and ventable outer balloon shell and an inner hard shell, which would be useful for football in this particular example. FIG. 1A shows a three-dimensional view of the pressurizable and ventable outer balloon shell which comprises a dome portion 1, a lower ballooned rim 2, a frontal ballooned rim 3, a face guard harness attachment 4 and a face guard 5. FIG. 1B shows an inner hard shell 5 which is to be encased by the pressurizable and ventable outer balloon shell shown in FIG. 1A.

Figure 2H:
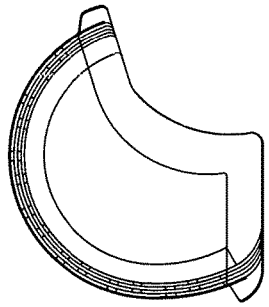
FIG. 2A~2H show a schematic profile view of individual components of the pressurizable and ventable outer balloon shell and the inner hard shell.
Figure 2D:
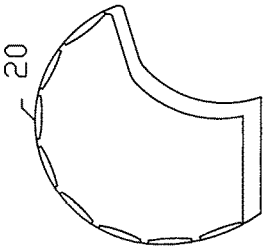
Figure 2C:
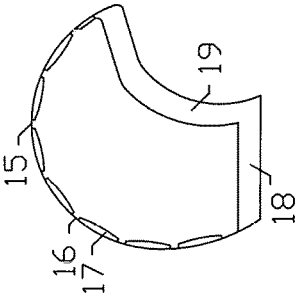
Figure 2F:
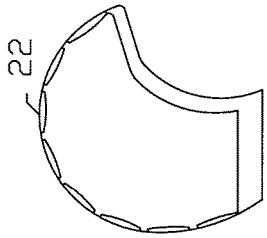
Figure 2E:
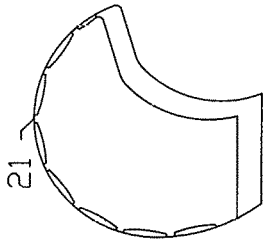
Figure 2G:
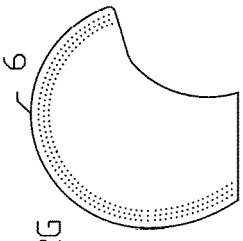
Figure 2A:
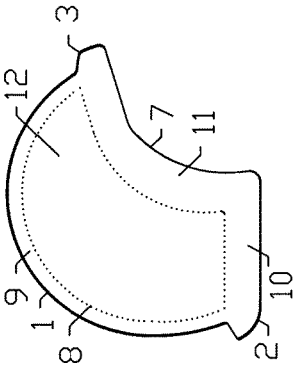
Figure 2B:
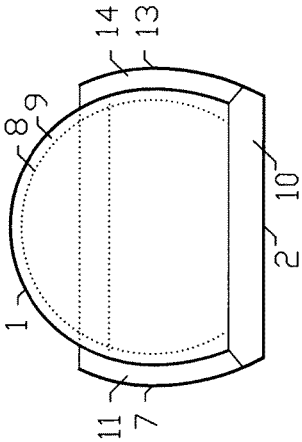

FIG. 2A~2H show a schematic profile view of individual components of the pressurizable and ventable outer balloon shell and the inner hard shell. FIG. 2A shows an outline view of the pressurizable and ventable outer balloon shell without independent inner layers inside the pressurizable and ventable outer balloon shell, which comprises the dome portion 1 adjoining the lower ballooned rim 2, the frontal ballooned rim 3 and a temporal ballooned rim 7. An inner wall 8 of the pressurizable and ventable outer balloon shell borders a balloonable internal space 9 of the dome portion 1, a balloonable internal space 11 of the temporal ballooned rim 7 and balloonable internal space 10 of the lower ballooned rim 2. A concave space 12 underneath the inner wall 8 of the pressurizable and ventable outer balloon shell encases the inner hard shell 5 shown in FIG. 1B. FIG. 2B of the posterior-to-anterior outline view of the pressurizable and ventable outer balloon shell without the independent inner layers shows both the temporal ballooned rims 7 and 13 with the corresponding balloonable internal space 11 and 14, respectively. FIG. 2C~2F show a schematic profile outline view of four independent inner layers 15 of FIG. 2C, 20 of FIG. 2D, 21 of FIG. 2E and 22 of FIG. 2F. FIG. 2G shows a schematic profile outline view of the inner hard shell 6. An outermost independent inner layer 15 shows a profile outline view of one ventable gas cell 17 arranged in a mosaic pattern with an intervening space 16 and a profile outline view of a temporal portion 19 and a lower portion 18 of a ruffled free end of the independent inner layer. The profile outline view of the inner hard shell 6 is shown with dotted dome shaped lines inside, indicating that the inner hard shell is multi-layered. FIG. 2H shows a schematic profile outline view of the pressurizable and ventable outer balloon shell with the independent inner layers and the inner hard encased inside the pressurizable and ventable outer balloon shell and of the inner hard shell.

Figure 3E:
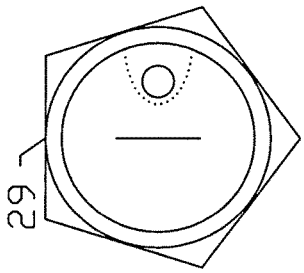
FIG. 3A~3G illustrate a schematic configuration of ventable gas cells attached on an inner surface of an independent inner layer.
Figure 3F:
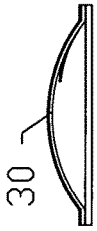
Figure 3G:
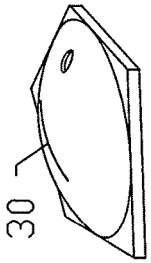
Figure 3B:
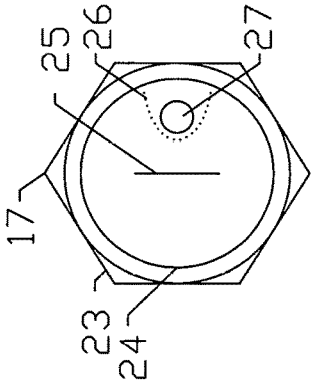
Figure 3C:
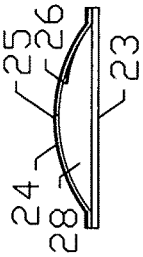
Figure 3D:
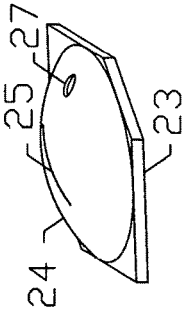
Figure 3A:
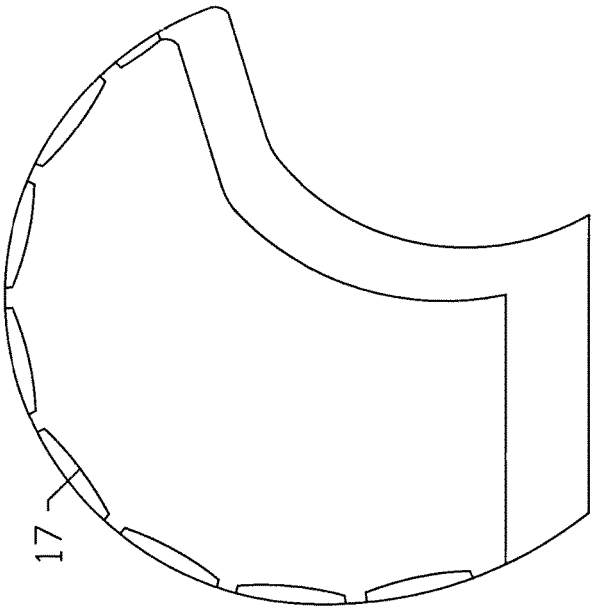

FIG. 3A illustrates a schematic profile outline view of ventable gas cells 17 attached on an inner surface of an independent inner layer arranged in tandem along the inner surface of the independent inner layer, which bulges toward a center of a dome configuration of the independent inner layer. FIG. 3B shows a schematic top-down outline view of the hexagonal ventable gas cell 17 which comprises a broad base 23 and a semi-elliptical dome 24 which is fixedly glued to the broad base 23. In a mid-line of the semi-elliptical dome, there is provided a gas vent slit 25 along a longitudinal axis of the semi-elliptical dome 24 and a gas intake opening 27 on one side of the semi-elliptical dome. The gas intake opening 27 is closed and opened by a one-way valve 26 which is disposed on an undersurface of the semi-elliptical dome. FIG. 3C shows a schematic profile outline view of the ventable gas cell with an inner space 28 formed by the broad base 23 and the semi-elliptical dome 24. The gas vent slit 25 is located on a top portion of the semi-elliptical dome 24. FIG. 3D shows a schematic three-dimensional view of the ventable gas cell. FIG. 3E shows a schematic top-down outline view of a pentagonal ventable gas cell 29 which is configured similarly. FIG. 3F shows a schematic profile outline view of the pentagonal ventable gas cell with the gas vent slit 30 located on a top portion of the semi-elliptical dome. FIG. 3G shows a schematic three-dimensional view of the pentagonal ventable gas cell.

Figure 4D:
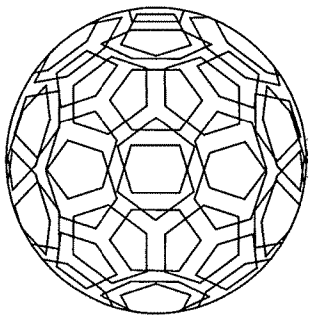
FIG. 4A~4D depict a schematic layout of a plurality of the independent inner layers stacked up in a concentric configuration inside the pressurizable outer balloon shell.
Figure 4B:
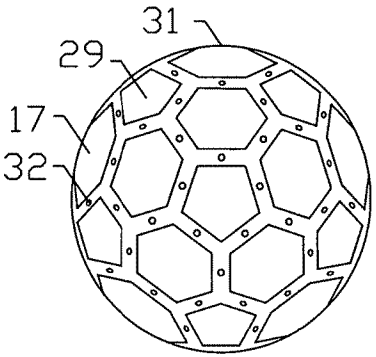
Figure 4C:
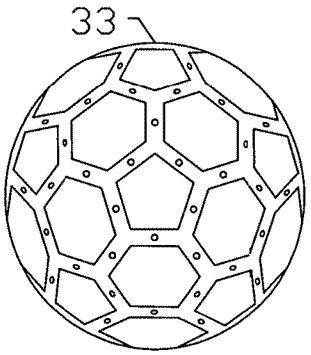
Figure 4A:
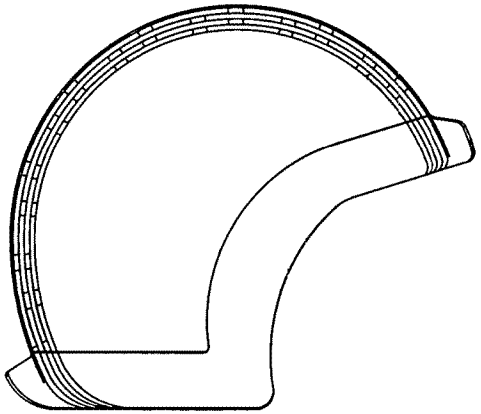

FIG. 4A~4D depict a schematic layout of a plurality of the independent inner layers stacked up in a concentric configuration inside the pressurizable outer balloon shell. FIG. 4A shows a schematic profile outline view of the independent inner layers in an interlaced configuration. FIG. 4B represents a layout of the hexagonal ventable gas cell 17 and the pentagonal ventable gas cell 29 arranged in a mosaic pattern on an independent inner layer 31 in a configuration having a central pentagon pointing toward a lower portion of the independent inner layer 31. In between the ventable gas cells, there is provided a plurality of perforated holes that go through an entire thickness of the independent inner layer. FIG. 4C illustrates a different configuration of the layout of the ventable gas cells in a configuration having a central pentagon pointing toward a upper portion of another independent inner layer 33. FIG. 4D shows a see-through outline view of both independent inner layers stacked up together in the interlaced configuration which allows one ventable gas cell to overlie one side of the other ventable gas cell across the slit of the other ventable gas cell shown in FIG. 3B and FIG. 3C resulting in two ventable gas cells to overlap one ventable gas cell.

FIG. 5A~5F shows a schematic illustration of an offset configuration of a gas vent slit on a semi-elliptical dome of the ventable gas cell. FIG. 5A shows a three-dimensional view of the ventable hexagonal gas cell having the slit 25 on the semi-elliptical dome 24 and the gas intake opening 27. FIG. 5B-5C show a schematic profile outline view of the semi-elliptical dome 24 which is made as a two-ply structure having an outer ply 35 bonded with an inner ply 37 under heat to form an inseparable sheet. In FIG. 5D, a magnified profile outline view of the slit 25 in a closed configuration shows an offset configuration of the slit, with an outer slit 34 separate by a distance from the inner slit 36 in a way that the outer ply 35 covers the inner slit 36 of the inner ply 37 for the offset distance between the outer slit 34 and the inner slit 36. The outer ply 35 is made of one thermoplastic elastomer and has a higher hardness on the Shore scale than the inner ply 37 made of a different thermoplastic elastomer having a softer hardness. On insufflation of a gas into the ventable gas cell, the inner ply 37 could be stretched but the outer ply 35 may not be stretchable by a pressurized gas inside the ventable gas cell, based on their difference in the hardness. The offset configuration of the two slits 34 and 36 is to let the semi-elliptical dome 24 distended by the pressurized gas which cannot escape through the inner slit 36 until the outer slit 34 is cracked open together with opening of the inner slit 36. FIG. 5E shows a schematic profile outline view of two independent inner layers having a layout of three ventable gas cells, with two ventable gas cells 38 and 40 on top of one ventable gas cell 42 below. One edge 39 of a broad base of the ventable gas cell 38 is vertically aligned with one side of a semi-elliptical dome of the ventable gas cell 42 across a slit 43 and the other edge 41 of a broad base of the ventable gas cell 40 is vertically aligned with the opposite side of the semi-elliptical dome of the ventable gas cell 42 across the slit 43. Upon an impact 44 at an angle to the ventable gas cells, both the edges 39 and 41 of the broad bases of the ventable gas cells 38 and 40, respectively, press down each side of the semi-elliptical dome of the ventable gas cell 42 along an opposite direction to a direction of the impact 44, opening the slit 43 thereby releasing a gas trapped inside the ventable gas cell 42. In FIG. 5F, a magnified profile outline view of the slit of the semi-elliptical dome illustrates an opening 45 of the outer ply 35 and an opening 46 of the inner ply 37. Until both plies 35 and 37 are open through the openings 45 and 46, the gas inside the ventable gas cell 42 will not be released.

Figure 6A:
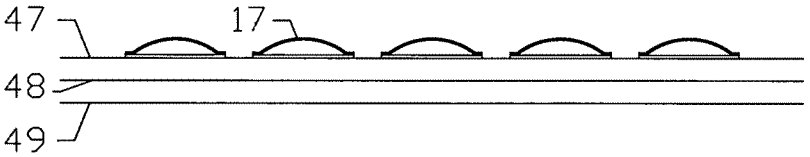
FIG. 6A~6D show a schematic drawing of components of the independent inner layer.
Figure 6B:
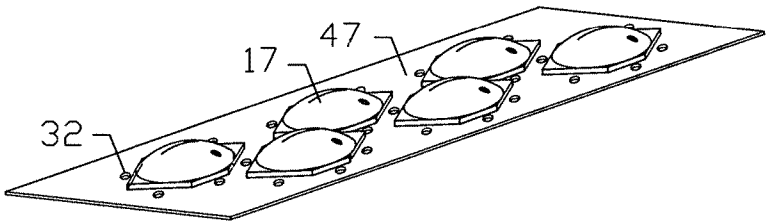
Figure 6C:
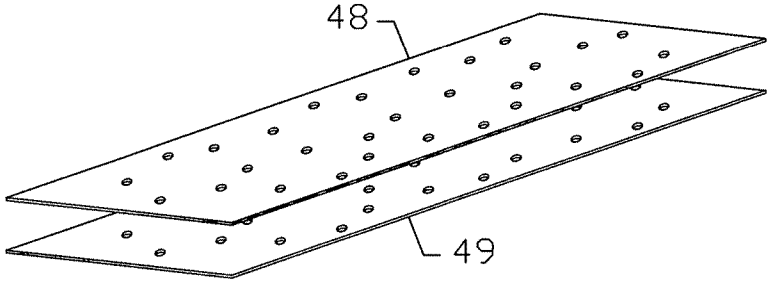
Figure 6D:
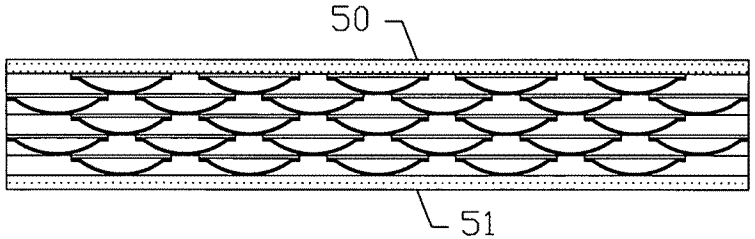

FIG. 6A~6D show a schematic drawing of the components of the independent inner layer. FIG. 6A shows a profile outline view of a three-ply structure of the independent inner layer which comprises an inner ply 47, a mid ply 48 and an outer ply 49. A plurality of ventable gas cell 17 are fixedly glued to an inner surface of the inner ply 47, arranged in tandem separated by a space. Both the inner ply 47 and outer ply 49 are made of a thermoplastic elastomer and the mid ply 48 is made of a woven cloth fabric. The three plies are bonded together under pressure and heat to impart enough hardness to maintain the dome configuration shown in FIG. 2C with reversible deformability over a range of temperature and enough tear strength to withstand repetitive deformative impacts from the blunt trauma without material failure, while reducing a natural vibration frequency of the thermoplastic elastomer by a natural vibration frequency of the woven cloth fabric. FIG. 6B shows a three-dimensional view of the inner ply 47 of the independent inner layer having a plurality of ventable gas cells 17 and a plurality of small holes 32 located in between ventable gas cells. FIG. 6C shows a three-dimensional view of the mid ply 48 and the outer ply 49 of the independent inner layer, with both of which showing a plurality of the small holes. FIG. 6D shows a schematic profile outline view of a section of the pressurizable and ventable outer balloon shell comprising an outer wall 50 and an inner wall 51 of the pressurizable and veritable outer balloon shell enclosing a plurality of stacked-up independent inner layers. A direction of convexity of each semi-elliptical dome of the ventable gas cell is toward the inner wall 51.

Figure 7A:
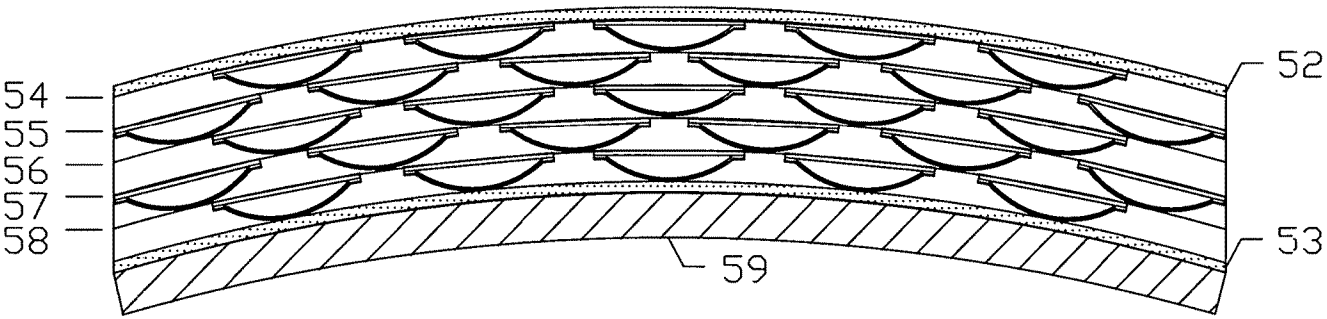
FIG. 7A-7B show a schematic profile outline view of an example of an operation of a section of the pressurizable and ventable outer balloon shell enclosing a plurality of stacked-up independent inner layers upon an impact.
Figure 7B:
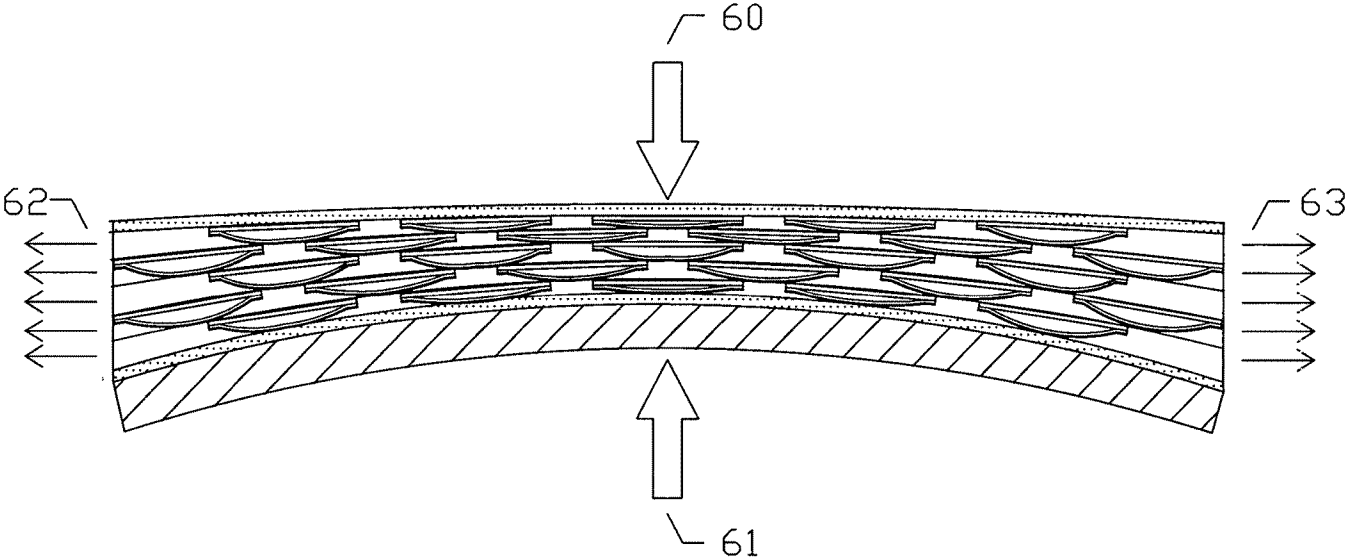

FIG. 7A-7B show a schematic profile outline view of an example of an operation of a section of the outer wall 52 and the inner wall 53 of the pressurizable and ventable outer balloon shell enclosing five stacked-up independent inner layers 54~58 and a section of the inner hard shell 59 upon an impact. FIG. 7A depicts a pressurized pressurizable and ventable outer balloon shell with a gas enclosing the stacked-up independent inner layers 54~58 having distended ventable gas cells with the gas before the impact. In FIG. 7B, upon an impact 60 of a blunt trauma toward a victim's head which generates a counter force 61 from the victim's head, both the pressurized pressurizable and ventable outer balloon shell and ventable gas cells attached to the independent inner layers are squeezed to increase a gas pressure inside the pressurized pressurizable and ventable outer balloon shell beyond a limit both the pressurizable and veritable outer balloon shell and ventable gas cells are configured to withstand. The pressurized gas inside both the pressurizable and ventable outer balloon shell and ventable gas cells is simultaneously released in directions 62 and 63 away from the impact through vents located around the ballooned rim, thereby decreasing an amplitude (kinetic energy) of the impact of the blunt trauma before the amplitude reaches the inner hard shell 59.

Figure 8A:
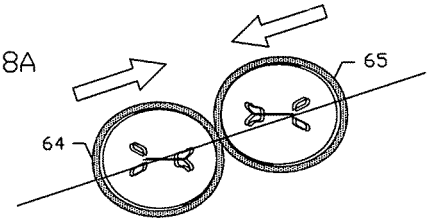
FIG. 8A~8G illustrate schematic outline views of examples of a collision between two oppositely placed human heads and mechanisms of the boundary effects of mechanical waves from the collision.
Figure 8B:
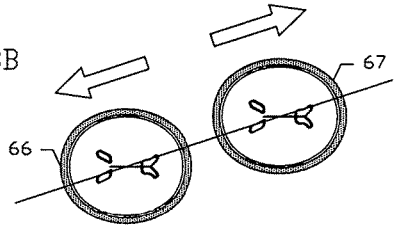
Figure 8C:
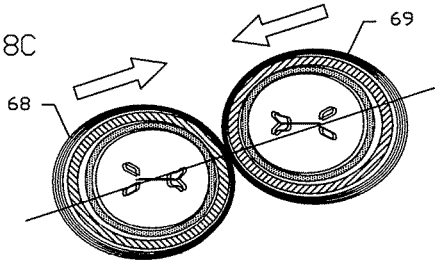
Figure 8D:
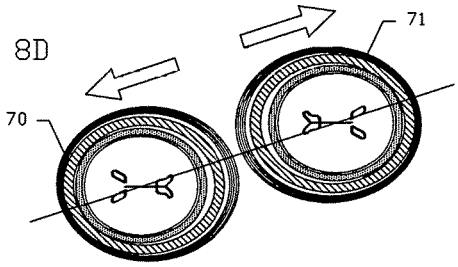
Figure 8E:
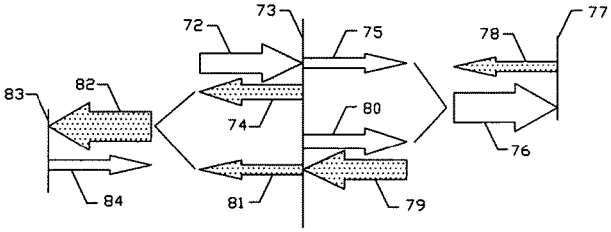

FIG. 8A~8G illustrate schematic outline views of examples of a collision between two oppositely placed human heads and mechanisms of the boundary effects of mechanical waves from the collision. FIG. 8A shows a diagonal frontal collision between two unprotected human heads 64 and 65, respectively. Following the collision, illustrated in FIG. 8B, both the heads 66 and 67 bounce back after having received and retaining full mechanical waves of the collision inside the head. FIG. 8C shows a diagonal frontal collision between two protected human heads 68 and 69, respectively, with each head wearing a headgear with the pressurizable and ventable outer balloon shell. Following the collision, illustrated in FIG. 8D, both the heads 70 and 71 wearing the headgear with the pressurizable and ventable outer balloon shell bounce back after having received and retaining reduced mechanical waves of the collision inside the head. FIG. 8E illustrates mechanical waves from the collision between the unprotected human heads, showing incident mechanical waves 72 from the head 64 of FIG. 8A coming to a boundary 73 established between a contact point of the collision between both the heads 64 and 65. The incident mechanical waves 72 are both reflected at the boundary 73 as 74 and transmitted as 75 across the boundary 73. Similarly, incident mechanical waves 79 from the head 65 of FIG. 8A are both reflected at the boundary 73 as 80 and transmitted as 81 across the boundary 73. Colliding mechanical waves toward and passing each other at a boundary of a matter produce zero displacement of the matter but stress (amplitude) delivered to the matter momentarily is doubled. Furthermore, polarity of the reflected waves at a fixed end of the matter is the same as that of the incident waves generating zero displacement but stress at the fixed end of the matter is doubled momentarily. Therefore, a sum of stress (amplitude) of the mechanical waves of 72+(74+81) becomes a total amplitude of the mechanical waves at the frontal part of the head 64 of FIG. 8A and a sum of stress (amplitude) of the mechanical waves of 79+(75+80) becomes a total amplitude of the mechanical waves at the frontal part of the head 65 of FIG. 8A. A sum of stress (amplitude) of the mechanical waves of 74+81 becomes an amplitude of mechanical waves 82 coming to a posterior boundary 83 of the head 64 of FIG. 8A. Similarly, a sum of stress (amplitude) of the mechanical waves of 75+80 becomes an amplitude of mechanical waves 76 coming to a posterior boundary 77 of the head 65 of FIG. 8A. At both the posterior boundaries 83 and 77, these mechanical waves 82 and 76 are reflected as 84 and 78, respectively. A sum of stress (amplitude) of 82+84 for the head 64 of FIG. 8A becomes an amplitude of the mechanical waves delivered to an occipital region of the head 64, causing an injury occurring in an opposite site of the original collision at 73. Similarly, a sum of stress (amplitude) of 76+78 for the head 65 of FIG. 8A becomes an amplitude of the mechanical waves delivered to an occipital region of the head 65.

Figure 8F:
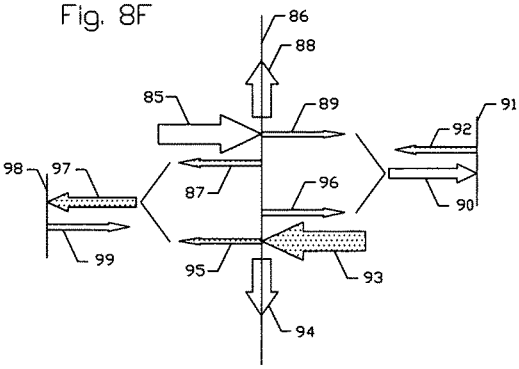

FIG. 8F shows mechanical waves delivered to the head wearing a protective headgear which has a pressurizable and ventable outer balloon shell having a single inner layer insufflated with a pressurized gas. Incident mechanical waves 85 from the head 68 of FIG. 8C come to a boundary 86 established between a contact point of the collision between the pressurizable and ventable outer balloon shells for each head 68 and 69. The incident mechanical waves 85 are reflected as 87 and released as 88 at the boundary 86 through the vents of the pressurizable and ventable outer balloon shell, and then transmitted as 89. Similarly, incident mechanical waves 93 from the head 69 of FIG. 8C are reflected as 96 at the boundary 86 and released as 94 at the boundary 86 through the vents of the pressurizable and ventable outer balloon shell, and then transmitted as 95 across the boundary 86. A sum of stress (amplitude) of the mechanical waves of 85+(87+95) becomes a total amplitude of the mechanical waves at the frontal part of the head 68 of FIG. 8C and a sum of stress (amplitude) of the mechanical waves of 93+(89+96) becomes a total amplitude of the mechanical waves at the frontal part of the head 69 of FIG. 8C. Similar to a mechanism of an increase in stress (amplitude) of the mechanical waves illustrated in FIG. 8E, a sum of stress (amplitude) of the mechanical waves of 87+95 becomes an amplitude of mechanical waves 97 coming to a posterior boundary 98 of the head 68 of FIG. 8C. For the head 69 of FIG. 8C, a sum of stress (amplitude) of the mechanical waves of 89+96 becomes an amplitude of mechanical waves 90 coming to a posterior boundary 91 of the head 69. At both the posterior boundaries 98 of the head 68 and 91 of the head 69 of FIG. 8C, these mechanical waves 97 and 90 are reflected as 99 and 92, respectively. A sum of stress (amplitude) of 97+99 for the head 68 of FIG. 8C becomes an amplitude of the mechanical waves delivered to an occipital region of the head 68. A sum of stress (amplitude) of 90+92 for the head 69 of FIG. 8C becomes an amplitude of the mechanical waves delivered to an occipital region of the head 69. The diagram of FIG. 8F illustrates a reduction in the amplitude of the mechanical waves to both the heads by releasing the pressurized gas from the the pressurizable and ventable outer balloon shell having a single inner layer.

Figure 8G:
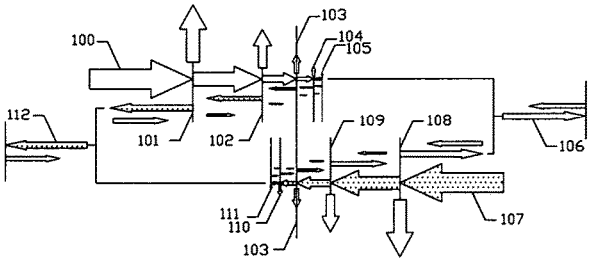

FIG. 8G shows mechanical waves on the head 68 of FIG. 8C wearing protective headgear having a pressurizable and ventable outer balloon shell with three inner layers inside the pressurizable and ventable outer balloon shell insufflated with a pressurized gas. Incident mechanical waves 100 from the head 68 of FIG. 8C come to a boundary 103 established between a contact point of the collision between the pressurizable and ventable outer balloon shells for each head 68 and 69. The incident mechanical waves 100 in this case needs to go through two additional boundaries of 101 and 102 undergoing a process of being reflected, transmitted and re-reflected at each boundary, while releasing the pressurized gas thereby reducing amplitudes of the mechanical waves at each boundary before being transmitted to the frontal region of the head 69 of FIG. 8C wearing a pressurizable and ventable outer balloon shell with three inner layers inside the pressurizable and ventable outer balloon shell insufflated with a pressurized gas. The same process of being reflected, transmitted and re-reflected while releasing the pressurized gas as on the boundaries of 103, 101 and 102 of the head 68 occurs upon each boundary of 103, 104 and 105 for the head 69 of FIG. 8C. Incident mechanical waves 107 from the head 69 of FIG. 8C undergo a similar process to what is described for the head 68 upon each boundary of 108, 109, 103, 110 and 111 before reaching the frontal region of the head 68. Amplitude of mechanical waves 112 and 106 reaching the occipital region of each head 68 and 69 therefore are substantially reduced by the release of the pressurized gas from the pressurizable and ventable outer balloon shell worn by each head 68 and 69. The diagram of FIG. 8G illustrates a significant reduction in the amplitude of the mechanical waves to both the heads by releasing the pressurized gas from the the pressurizable and ventable outer balloon shell having multiple inner layers serving as boundary for the mechanical waves.

Figure 9A:
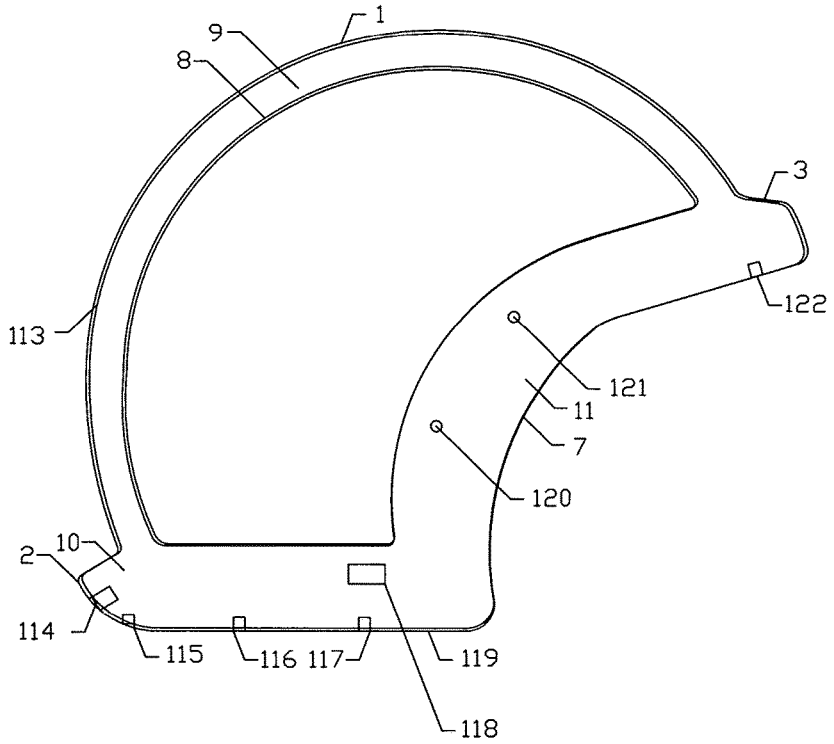
FIG. 9A-9B show a schematic detailed view of the pressurizable and ventable outer balloon shell.
Figure 9B:
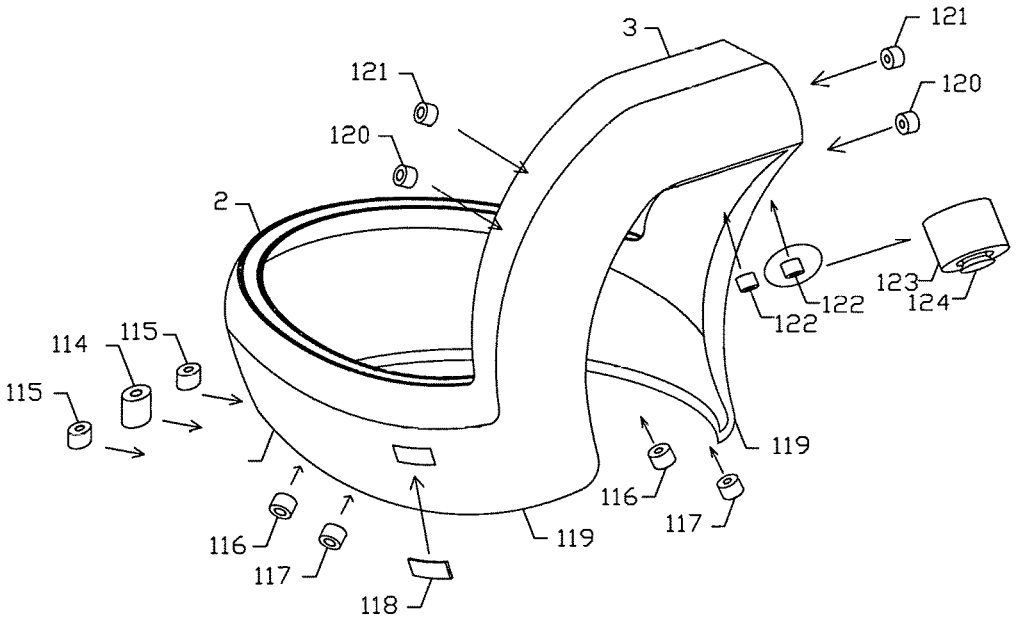

FIG. 9A 9B show a schematic view of the pressurizable and ventable outer balloon shell. FIG. 9A shows a schematic profile outline view of the pressurizable and ventable outer balloon shell having a Schrader-type gas intake valve 114 embedded in a lower wall of the lower ballooned rim 2 below an occipital portion 113 of the dome 1 into the balloonable internal space 10, spring-operated pressure release gas valves 115~117 disposed in the lower wall of the lower ballooned rim 2, and a pressure sensor device 118 located above an anterior portion 119 of the lower ballooned rim. Additional spring-operated pressure release gas valves 120~121 and 122 are disposed in the temporal ballooned rim 7 and the frontal ballooned rim 3, respectively. FIG. 9B shows a schematic three-dimensional view of the ballooned rim with the Schrader-type gas valve, the spring-operated pressure release gas valves and the pressure sensor device, with an upper portion of the lower ballooned rim exposed. One frontal spring-operated pressure release gas valve 122 is shown magnified, having a cylindrical configuration with an outer cylinder 123 and a valve 124 which is pushable by a spring and quick-release.

Figure 10A:
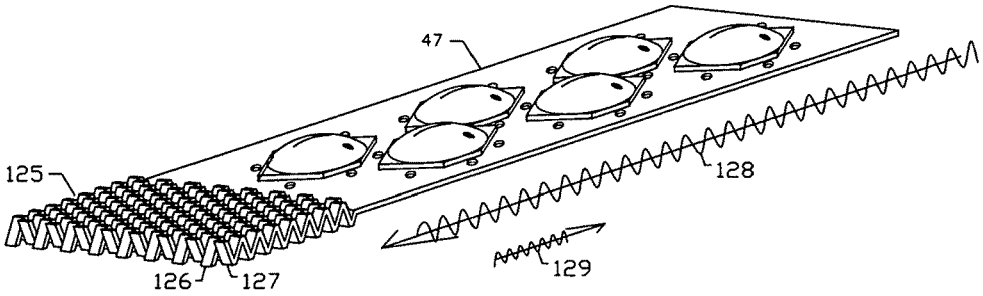
FIG. 10A~10F illustrate a ruffled free end of the independent inner layer and surface waves across a human head upon an impact.
Figure 10B:
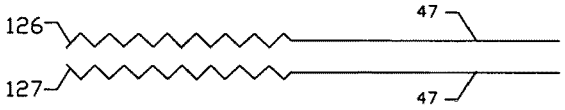
Figure 10C:
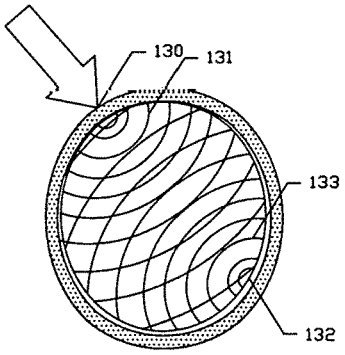
Figure 10D:
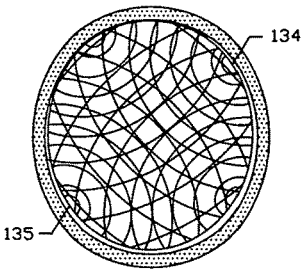
Figure 10E:
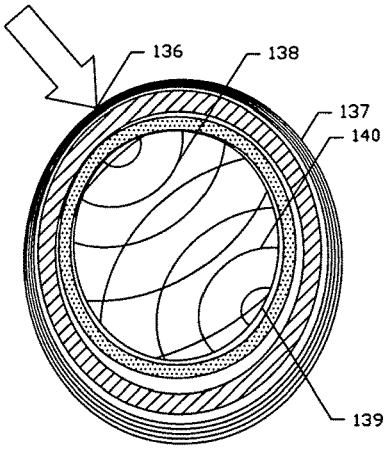
Figure 10F:
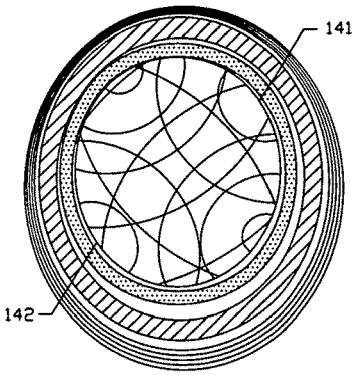

FIG. 10A~10F illustrate a ruffled free end 125 of an independent inner layer 47 and propagation of surface waves across a human head upon an impact. FIG. 10A shows a schematic view of the ruffled free end 125 of the independent inner layer 47. The ruffled free end 125 is configured in a plurality of thin linear strips for a length with one end coming out as an extension from an edge of the independent inner layer and the other end being free and unattached. Schematically illustrated in FIG. 10B, the ruffled free end 125 is press-made in a configuration of two out-of-phase sine waves 126 and 127 along a longitudinal axis of the ruffled free end, which is to reduce a resonant vibration 129 of the independent inner layer and the ruffled free end by their fundamental frequency resonating with a frequency 128 of a mechanical wave from an impact. FIG. 10C~10D show the surface waves 131 and 133 originating from an impact site 130 and an opposite site 132 causing resonant amplification of mechanical waves disseminating from distant sites 134 and 135 away from the sites 130 and 132 upon the impact on an unprotected human head. FIG. 10E-10F show the surface waves 138 and 140 originating from an impact site 136 on a pressurizable and ventable outer balloon shell 137 and an opposite site 139 with resonant amplification of mechanical waves disseminating from distant sites 141 and 142 away from the sites 136 and 139 upon the impact on a protected human head wearing the protective headgear having the pressurizable and ventable outer balloon shell 137. Referring to FIG. 6, the woven cloth fabric of the mid ply 48 also contributes to dampening the resonant amplification of the mechanical waves by the independent inner layer based on a lower fundamental frequency of the woven cloth fabric compared to that of the outer and inner plies 47 and 49 made of the thermoplastic elastomer.

Figure 11B:
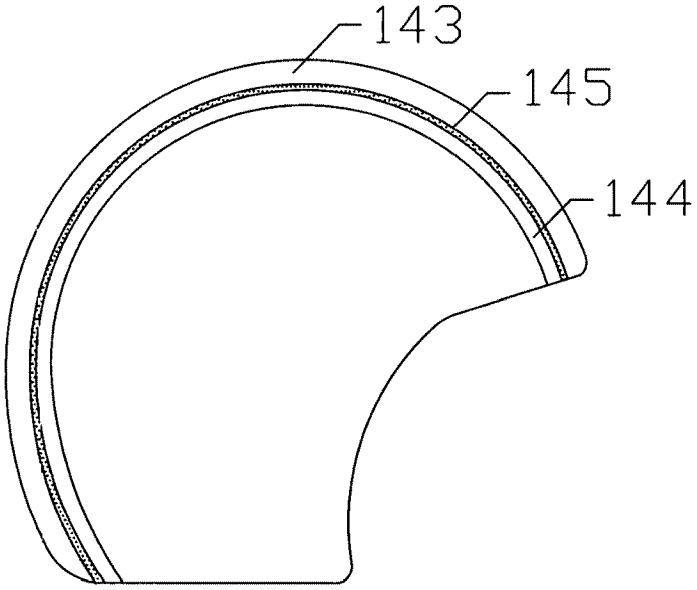
FIG. 11A-11B show a schematic view of the inner hard shell.
Figure 11A:
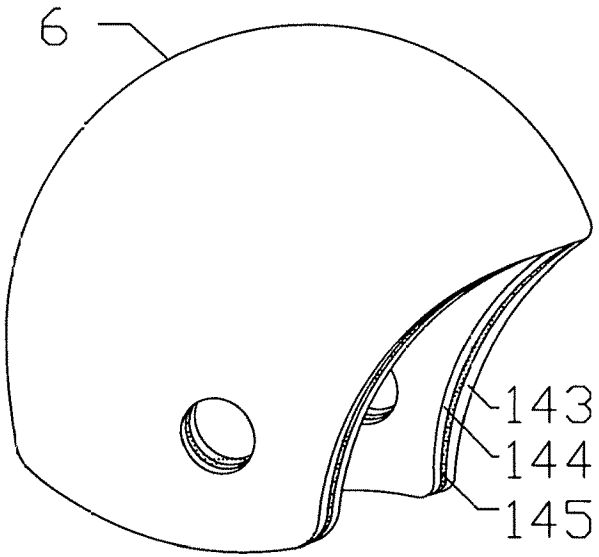

FIG. 11A-11B show a schematic view of a configuration of the inner hard shell 6 which is undeformable and resistant to material failure upon impact of a blunt trauma. FIG. 11A shows a schematic three-dimensional view of the inner hard shell, comprising at least three layers with both the outer 143 and inner layer 144 made of an impact resistant polymer and the mid layer 145 made of a plurality of non-polymeric porous materials. FIG. 11B shows a schematic profile outline view of a three-layered structure of the inner hard shell. Main role of the three layers is to protect the skull against fracture upon an impact of a blunt trauma to the head. The mid layer 145 of the non-polymeric porous materials serves to reduce transmission of an amplitude of the blunt trauma through the inner hard shell.

It is to be understood that the aforementioned description of the apparatus and methods is simple illustrative embodiments of the principles of the present invention. Various modifications and variations of the description of the present invention are expected to occur to those skilled in the art without departing from the spirit and scope of the present invention. Therefore the present invention is to be defined not by the aforementioned description but instead by the spirit and scope of the following claims.

What is claimed is:

1. A mechanical-waves dispersing protective headgear apparatus, comprising:

a pressurizable and ventable outer balloon shell enclosing a plurality of inner layers, and an inner hard shell;

the pressurizable and ventable outer balloon shell, provided as an airtight shell reversibly pressurizable by a gas, which is configured to be reversibly and depressibly deformable by an impact of a blunt trauma at an angle to a planar surface of said pressurizable and ventable outer balloon shell, which is configured to release the gas upon said impact of said blunt trauma, which comprises a dome configured in a substantially hemispherical bowl shape conforming to a human head and a ballooned rim adjoining a circumferential margin of the dome, which provides a pressurizable space that encloses a plurality of the inner layers concentrically stacked up, which has a pressurized-gas intake valve and a plurality of pressure-triggerable gas release valves on a lower surface of a circumference of the ballooned rim, which has a pressure sensor device disposed on an outer surface of the ballooned rim having an alarm function for a gas pressure above or below an expected range of the gas pressure inside said pressurizable and ventable outer balloon shell and which slidably encases the inner hard shell; and the inner hard shell, provided in a single-piece dome configuration, which comprises at least three tight-bonded layers with an outer layer and an inner layer made of an impact resistant polymer and a mid layer made of a plurality of non-polymeric porous materials, which is undeformable upon the impact of the blunt trauma, which covers an area of the human head, which is configured to prevent fracture of a skull upon the impact of the blunt trauma to the skull and which is configured to reduce transmission of mechanical waves of the impact across said inner hard shell.

2. The mechanical-waves dispersing protective headgear apparatus according to claim 1, wherein the inner layer comprises:

the inner layer, provided as a reversibly deformable thin sheet in a dome configuration covering a majority of an inner surface of an outer wall of the pressurizable and ventable outer balloon shell, which is enclosed detachably inside the pressurizable and ventable outer balloon shell, which comprises a plurality of ventable gas cells fixedly attached to an inner surface of said inner layer arranged in a mosaic pattern and a plurality of penetrating holes through an entire thickness of said inner layer in between the ventable gas cells, which comprises a ruffled free end extending from a circumferential edge of said inner layer, which serves as a boundary to the mechanical waves and which is configured to reduce amplification of an amplitude of the mechanical waves across said inner layer;

the ventable gas cell, provided in a configuration of a broad base fixedly glued to a two-ply deformable semi-elliptical dome to produce a reversibly closable gas space, which is configured to maintain an equal pressure of the gas inside said ventable gas cell to a pressure of said gas in the pressurizable and ventable outer balloon shell outside said ventable gas cell and which is configured to retain a pressurized gas inside said ventable gas cell by and to release said gas through a two-ply offset gas vent slit of said semi-elliptical dome; and the ruffled free end, provided in a configuration of a plurality of thin linear strips for a length with one end of said ruffled free end being an extension from the circumferential edge of said inner layer and the other end being free and unattached, which is detachably housed inside the ballooned rim, which detachably anchors said inner layer inside said ballooned rim and which is configured to reduce resonant vibration of said inner layer upon a delivery of the mechanical waves of the impact of the blunt trauma to said inner layer.

3. The mechanical-waves dispersing protective headgear apparatus according to claim 1, wherein the pressurizable and ventable outer balloon shell is made of a semi-rigid thermoplastic elastomer which withstands a range of the gas pressure inside said pressurizable and ventable outer balloon shell above atmospheric pressure over a range of temperature from 0° F. to 175° F. and the mechanical waves from the impact of the blunt trauma.

4. The mechanical-waves dispersing protective headgear apparatus according to claim 1, wherein the pressurizable and ventable outer balloon shell is configured to be inflatably pressurized above atmospheric pressure by insufflation of the gas into said pressurizable and ventable outer balloon shell through the pressurized-gas intake valve and which is configured to release the pressurized gas to atmosphere through the pressure-triggerable gas release valves by reversibly depressive deformation of the outer wall of said pressurizable and ventable outer balloon shell squeezing out said pressurized gas at the site of the impact of the blunt trauma through said pressure-triggerablc gas release valves upon said impact of said blunt trauma that increases the gas pressure in said pressurizable and ventable outer balloon shell above a predetermined limit of pressurization of said gas pressure, thereby reducing an amplitude of the mechanical waves of the impact of the blunt trauma.

5. The mechanical-waves dispersing protective headgear apparatus according to claim 1, wherein the gas pressure inside the pressurizable and ventable outer balloon shell is variably adjustable in proportion to a sum of a maximum anticipated weight of a source of the blunt trauma and a known weight of a victim of said blunt trauma, an anticipated velocity of the blunt trauma and an anticipated type of the blunt trauma.

6. The mechanical-waves dispersing protective headgear apparatus according to claim 1, wherein at least one pressure-triggerable gas release valve is assigned to each anatomic region of the human head, including frontal, parietal, temporal and occipital regions to facilitate release of the gas upon the impact on a particular region of the head through a nearest regional pressure-triggerable gas release valve.

7. The mechanical-waves dispersing protective headgear apparatus according to claim 2, wherein the inner layer comprises at least three tightly bonded plies with an outer ply and an inner ply made of a thermoplastic elastomer and a mid ply made of a plurality of non-polymeric porous materials, which is configured to dampen a fundamental frequency of vibration of said outer and inner plies by a lower fundamental frequency of vibration of the mid ply.

8. The mechanical-waves dispersing protective headgear apparatus according to claim 2, wherein the ventable gas cell comprises an opening on one side of the semi-elliptical dome of said gas cell through which the gas inside the pressurizable and ventable outer balloon shell moves into an inner space of said ventable gas cell and gets trapped by an one-way flap valve attached to an inner surface of said semi-elliptical dome until the gas pressure inside said pressurizable and ventable outer balloon shell is equalized with the gas pressure inside said inner space of said ventable gas cell.

9. The mechanical-waves dispersing protective headgear apparatus according to claim 2, wherein the semi-elliptical dome comprises:

an outer ply made of a thermoplastic elastomer having a higher hardness on the Shore scale than an inner ply made of a different thermoplastic elastomer that is fixedly bonded with the outer ply;

a gas vent slit on a relatively mid line of said semi-elliptical dome along a longitudinal axis of said semi-elliptical dome is provided in an offset configuration with an outer slit in the outer ply separated by a distance from and running in parallel with an inner slit in the inner ply, with the outer ply configured to cover the inner slit for said distance;

the gas vent slit is in a closed configuration with the outer ply covering the inner slit preventing said inner slit from opening when the gas from the pressurizable space of the pressurizable and ventable outer balloon shell moves inside said ventable gas cell and the semi-elliptical dome is distended with the gas but not pressed down; and the gas vent slit is in an open configuration when both convex sides of the semi-elliptical dome across the gas vent slit are pressed down to a point both the outer slit and inner slit are concurrently open, through which the gas inside said ventable gas cell is released to the pressurizable space of the pressurizable and ventable outer balloon shell.

10. The mechanical-waves dispersing protective headgear apparatus according to claim 2, wherein a plurality of the inner layers are concentrically stacked up in the pressurizable and ventable outer balloon shell in an interlaced configuration that each convex side of the semi-elliptical dome across the gas vent slit of said semi-elliptical dome of a ventable gas cell of the first inner layer is aligned with an edge of each broad base of another ventable gas cell of the second inner layer disposed under said first inner layer.

11. The mechanical-waves dispersing protective headgear apparatus according to claim 2, wherein a plurality of the inner layers are configured to compartmentalize a region of the impact of the blunt trauma for, releasing the pressurized gas from said region of said impact of said blunt trauma to preferentially reduce the amplitude of the impact of the blunt trauma at the region of the impact by venting a plurality of the ventable gas cells of the inner layers clustered around the region of the impact of the blunt trauma as a primary release of the pressurized gas to the pressurizable space of the pressurizable and ventable outer balloon shell outside said plurality of said ventable gas cells.

12. The mechanical-waves dispersing protective headgear apparatus according to claim 2, wherein the ruffled free end is provided in a corrugated configuration in two out-of-phase sine waves along a longitudinal axis of said ruffled free end, with the first strip of said ruffled free end having one sine wave configuration and the second strip of said ruffled free end having an out-of-phase sine wave configuration with the sine wave configuration of the first strip.

* * * * *